US006409232B1

(12) United States Patent
Nigro, Jr. et al.

(10) Patent No.: US 6,409,232 B1
(45) Date of Patent: Jun. 25, 2002

(54) EXIT ALARM LOCK ASSEMBLY WITH PUSH PAD PIVOTALLY INTERCONNECTED TO DEADBOLT

(75) Inventors: Daniel N. Nigro, Jr., Ocean Springs, MS (US); Eugene Karl Siller, Indianapolis, IN (US)

(73) Assignee: Von Duprin, Inc., Indianapolis, IN (US)

( * ) Notice: Subject to any disclaimer, the term of this patent is extended or adjusted under 35 U.S.C. 154(b) by 0 days.

(21) Appl. No.: 09/569,846

(22) Filed: May 12, 2000

Related U.S. Application Data

(60) Provisional application No. 60/134,014, filed on May 12, 1999.

(51) Int. Cl.[7] ..... E05B 65/10

(52) U.S. Cl. ..... 292/92; 292/140; 292/169; 70/92

(58) Field of Search ..... 292/92, 93, 164, 292/167, 169.14, 169.17, 169, 170, 140; 70/92

(56) References Cited

U.S. PATENT DOCUMENTS

| | | | | | |
|---|---|---|---|---|---|
| 376,252 | A | | 1/1888 | McIntyre | |
| 930,000 | A | * | 8/1909 | Waldecker | 70/92 |
| 1,441,336 | A | | 1/1923 | Flowers | |
| 1,535,210 | A | * | 4/1925 | Dyer | 70/92 |
| 1,676,867 | A | | 7/1928 | Moore et al. | |
| 3,432,631 | A | * | 3/1969 | Deutscher | 292/92 |
| 3,765,198 | A | * | 10/1973 | Horgan | 70/92 |
| 3,819,213 | A | * | 6/1974 | Vanderburgh | 70/92 |
| 3,877,262 | A | * | 4/1975 | Williams | 292/92 |
| 4,083,590 | A | | 4/1978 | Folger | |
| 5,219,385 | A | * | 6/1993 | Yeh | 292/92 |
| 5,605,362 | A | * | 2/1997 | Surko | 292/92 |
| 5,947,534 | A | * | 9/1999 | Zarzycki | 292/92 |

FOREIGN PATENT DOCUMENTS

| | | | | |
|---|---|---|---|---|
| GB | 419897 | * | 11/1943 | 70/92 |

* cited by examiner

*Primary Examiner*—Flemming Saether
(74) *Attorney, Agent, or Firm*—Michael Best & Friedrich LLP

(57) ABSTRACT

An improved exit alarm lock including a push pad moveable between an extended position and a depressed position; a pivotable first bell crank, a first end of the first bell crank being connected to a first end of the push pad; a pivotable support connected to a second end of the push pad; and a deadbolt moveable between a retracted position and an extended position, a second end of the first bell crank directly engaging the deadbolt, whereby when the push pad is moved to the depressed position, the push pad pivots the first bell crank, the first bell crank second end contacts the deadbolt and moves the deadbolt from the extended position to the retracted position.

19 Claims, 10 Drawing Sheets

EXIT ALARM LOCK ASSEMBLY WITH PUSH PAD PIVOTALLY INTERCONNECTED TO DEADBOLT

This application claims the benefit under 35 U.S.C. §119 (e) of the U.S. provisional application No. 60/134,014, filed May 12, 1999.

BACKGROUND OF THE INVENTION

This invention relates generally to exit devices and more particularly to exit alarm locks.

An exit alarm lock is a door lock assembly that sounds an audible horn or alarm at the push-activated release of the locking element. These door locks are often used on the back doors of retail establishments such as restaurants and strip malls as a deterrent to unauthorized egress through the openings upon which the devices are installed. Their use is typically provoked by a security event such as internal shrinkage by employees or customers. In addition, these devices maintain the security of the openings from external events such as burglaries or vandalism. Finally, these devices must often meet building code requirements to allow safe and uninhibited egress through the opening in the event of an emergency. As these criteria are fairly broad, many devices on the market currently are unable to adequately meet the intent of all three characteristics.

The foregoing illustrates limitations known to exist in present exit devices. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an exit device comprising: a push pad moveable between an extended position and a depressed position; a pair of pivotable first bell cranks, a first end of each first bell crank being connected to a first end of the push pad; a pair of pivotable supports connected to a second end of the push pad; and a deadbolt moveable between a retracted position and an extended position, a second end of each first bell crank being directly engaging the dead-bolt, whereby when the push pad is moved to the depressed position, the push pad pivots the first bell cranks, the first bell crank second ends contact the deadbolt and move the deadbolt from the extended position to the retracted position.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
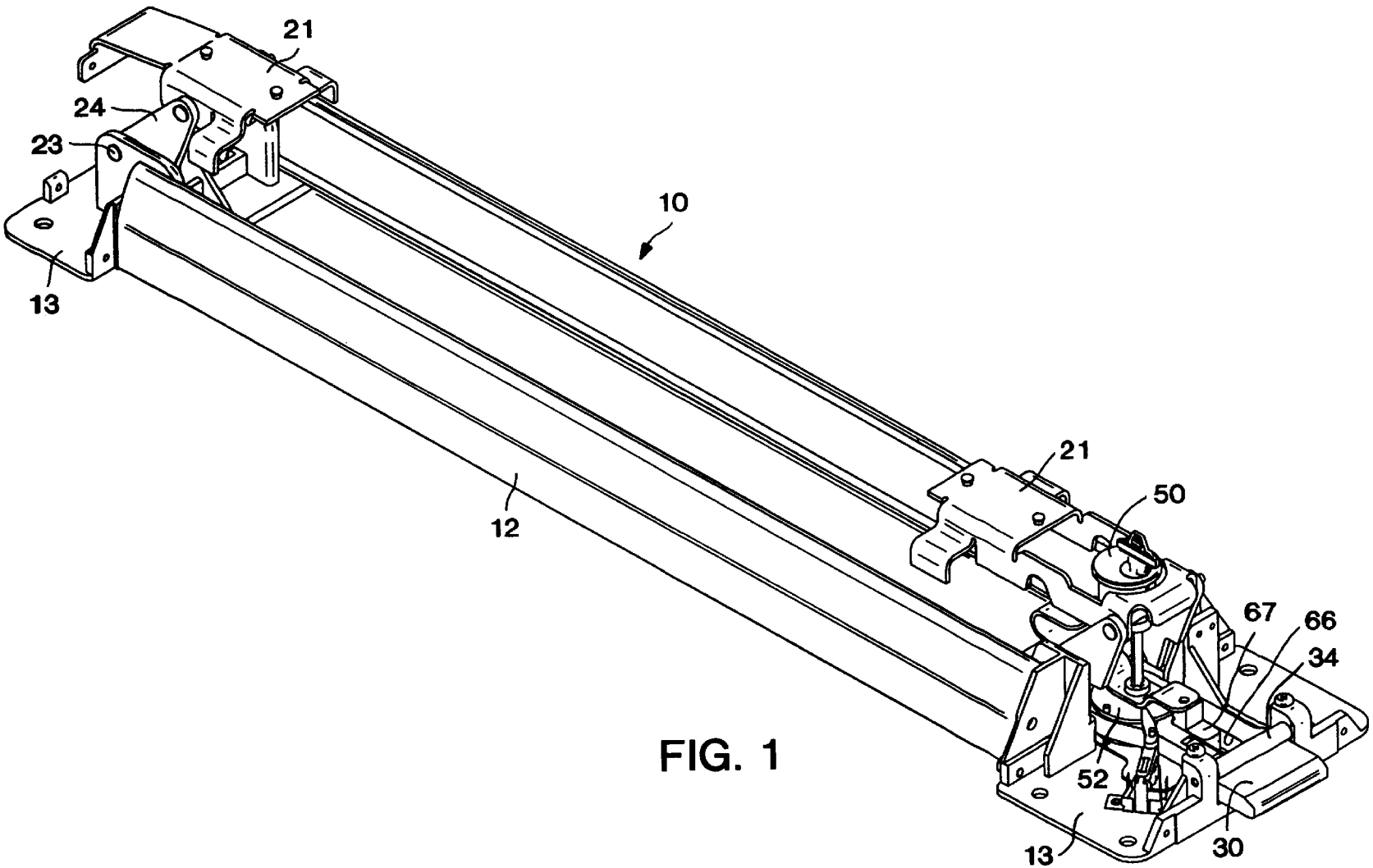
FIG. 1 is a perspective view of an exit device showing the present invention, with certain components removed for clarity.
Figure 2:
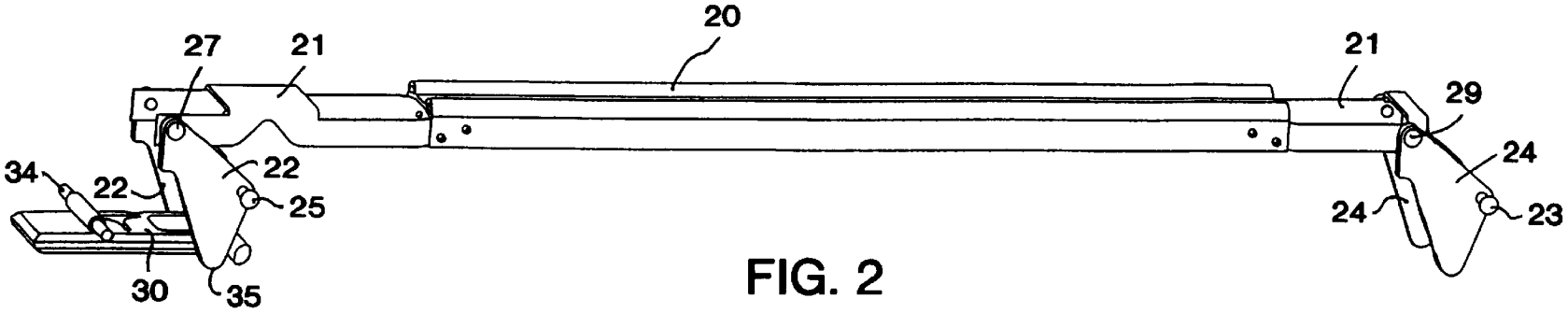
FIG. 2 is a schematic perspective view of the exit device shown in FIG. 1, illustrating the pushbar, bell cranks, and deadbolt.

FIG. 1 shows an exit device 10, which is preferably an exit alarm lock, such as that described in the preferred embodiment in this application and in provisional patent applications Nos. 60/133,007, 60/133,027 and 60/134,013, the disclosures of which are hereby incorporated by reference. A housing 12, which includes two end brackets 13, forms the base for the exit device 10. A pushbar 20 is attached to two pushbar mounting brackets 21 which are pivotably attached to the housing 12 by two pairs of pivotable supports 22, 24. The pushbar 20 is moveable between a normal position, shown in FIG. 2, and a depressed position. Preferably, both pairs of pivotable supports 22, 24 are bell cranks and most preferably, pivotable supports 22 are bell cranks. Preferably, each pair of bell cranks 21, 22 is interconnected by a bridge forming a single bell crank attached to each end of the pushbar 20. This interconnect improves the stability and reliability of the exit device 10. The bell cranks 22, 24 pivot about an axis 25, which is also the attachment point of the bell cranks 22, 24 to the housing 12. The bell cranks 22, 24 are pivotably attached to the pushbar 20 at attachment points 27, 29, respectively. Although the FIGURES show an exit alarm lock, the present inventions described herein can also be used with typical exit devices.

Figure 3A:
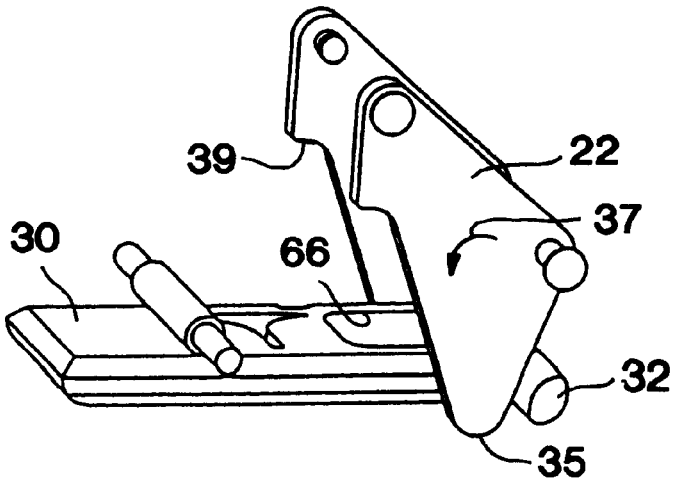
FIGS. 3A through 3D are schematic perspective views of the exit device shown in FIG. 2, illustrating the operation of the pushbar, the bell cranks and the deadbolt.
Figure 3B:
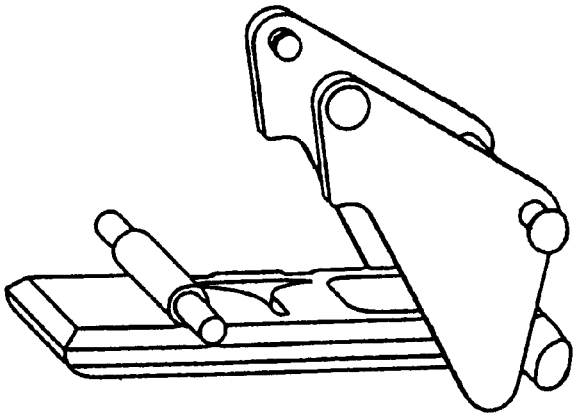
Figure 3C:
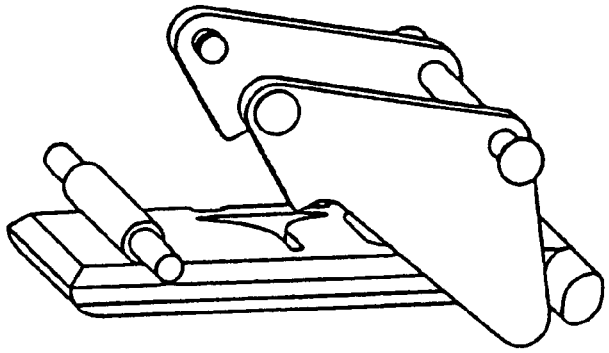
Figure 3D:
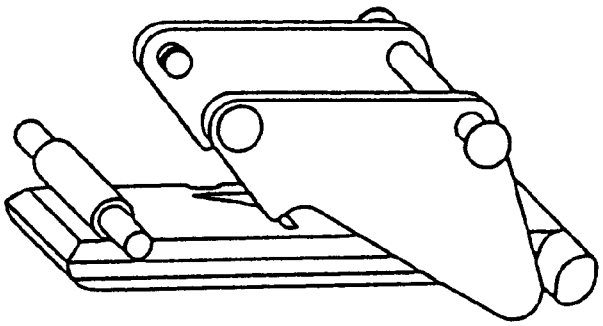

A deadbolt 30 is slidably mounted within the lock end end bracket 13. An inner end of the deadbolt 30 has a pair of shoulders 32, or bell crank engagement surfaces, thereon. A roller 34 is attached to lock end end bracket 13 to provide rolling support for the deadbolt 30 as it moves between an extended position, shown in FIG. 3A and a retracted position, shown in FIG. 3D. Each of the first bell cranks 22 has a backside 35 on an end of the bell crank remote from attachment point 27 and on the opposite side of the axis of pivot 25 from attachment point 27. When the pushbar 20 is depressed, pivoting the bell cranks 22 in the direction of arrow 37, shown in FIG. 3A, this backside 35 contacts the deadbolt shoulders 32. Further rotation of the bell cranks 22 results in the bell cranks 22 causing deadbolt 30 to move from the extended position to the retracted position, see FIGS. 3A through 3D. A biasing means (not shown), preferably a spring, is used to return the pushbar 20 to an upright position when the pushbar is released.

The retraction of the deadbolt 30 via pushbar 20 actuation operates on a simple interference cam principle. The pushbar 20 is connected to pivotable bell cranks 22, 24, which control and stabilize the motion of the pushbar 20 into a basic parallelogram four-bar mechanism. When the pushbar 20 is depressed, force is transmitted to two pins 27, 29 connecting the bell cranks 22, 24 to the pushbar 20. Since these pins 27, 29 are offset to one side of the bell cranks' rotational axis, 25, 23, the bell cranks 22, 24 begin to rotate (See FIGS. 3A through 3D). The deadbolt 30 is constructed so as to have two contact "ears" or shoulders 32 which interfere with the backside 35 of the bell cranks 22. The rotational motion of the bell cranks 22 results in the contact between the backside 35 of the bell cranks 22 and the deadbolt shoulders 32. This contact allows forces to be transmitted to the deadbolt 30, effectively converting rotary motion into the linear motion of the deadbolt. As the bell cranks 22, 24 go through the forty degree rotation, the deadbolt 30 moves horizontally retracting into the housing 12. The entire bell crank 22, 24 rotation stays within one quadrant, so it never crosses the extreme horizontal position which eliminates the need for an action rod to distribute the force evenly between both bell cranks 22, 24. To help assure this, a stabilizing means can be provided. One stabilizing means uses the interaction of a center slot 66 in deadbolt 30 and a deadbolt center support 67 (see FIG. 1). Prior to rotation of the bell cranks 22, 24 going beyond one quadrant, the deadbolt 30 has moved such that center support 67 hits an edge of center slot 66 stopping further movement of deadbolt 30. Because of the shoulders 32 on deadbolt 30 engaging bell crank backside 35, further movement of the bell cranks is prevented. Other stabilizing means can include: a mounting pad on the end bracket 13 adjacent bell crank 24 which blocks movement of bell crank 24 from moving beyond one quadrant, or a shoulder on bell crank 22 impacting on a portion of the end bracket 13. This allows for a uniform retraction force along the entire length of the pushbar 30 to retract the deadbolt 30. Because of the designed geometry of the bell cranks, the mechanism has an inherent mechanical advantage which enables the deadbolt 30 to be easily retracted into the housing with a minimal actuation force along any point from the hinge to the lock stile. This bell crank design allows a predictable low force actuation along any point from the hinge to the lock stile. The pushbar 20 is returned to its original or normal position by two coiled return springs (not shown).

Figure 4A:
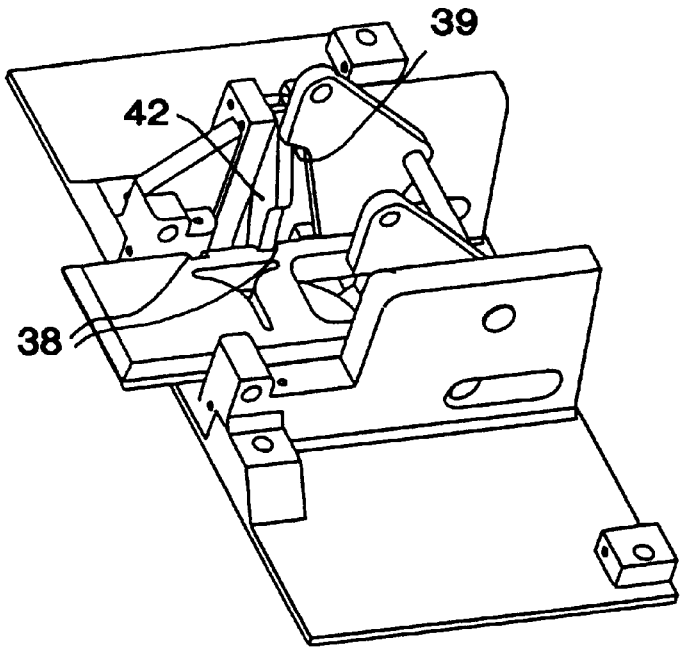
FIGS. 4A through 4E are schematic perspective views of the exit device shown in FIG. 2, illustrating the operation of the dead locking link and the interaction with the bell cranks.
Figure 4B:
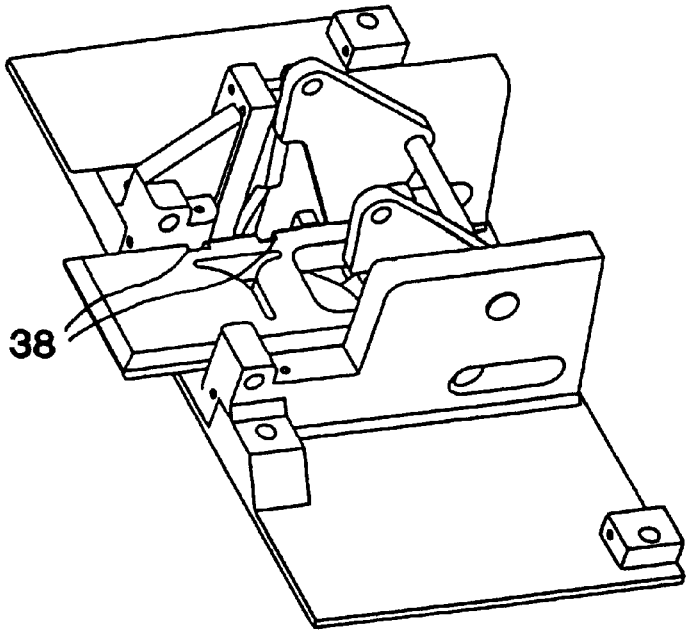
Figure 4C:
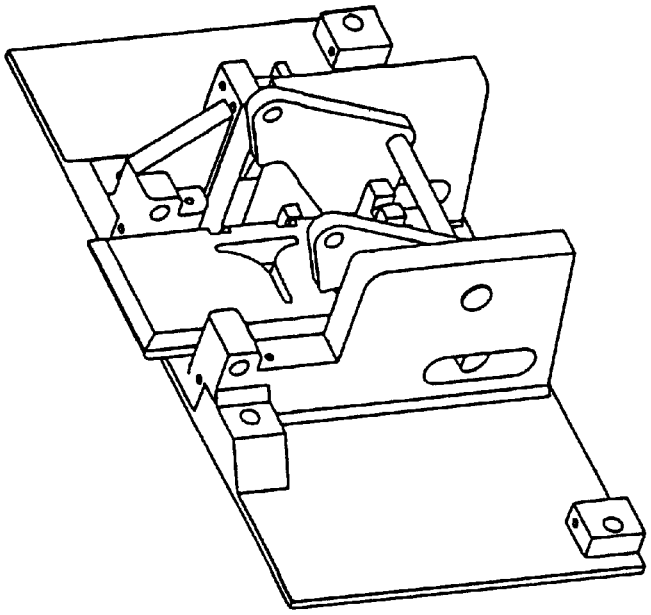
Figure 4D:
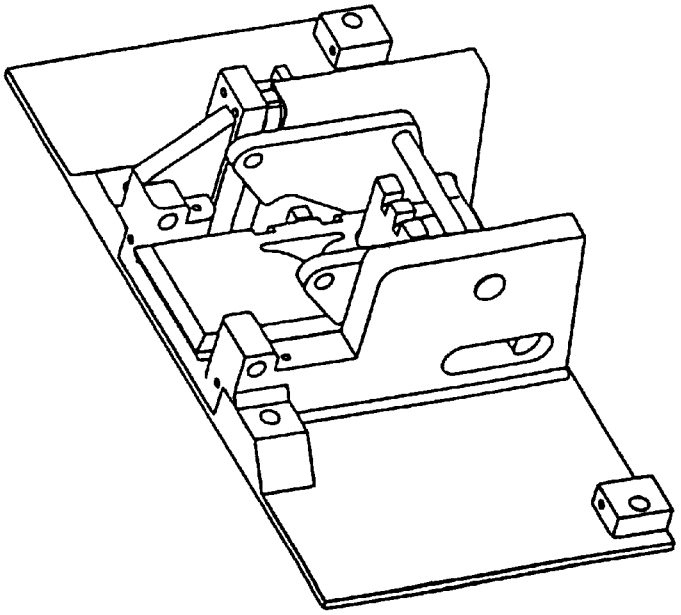
Figure 4E:
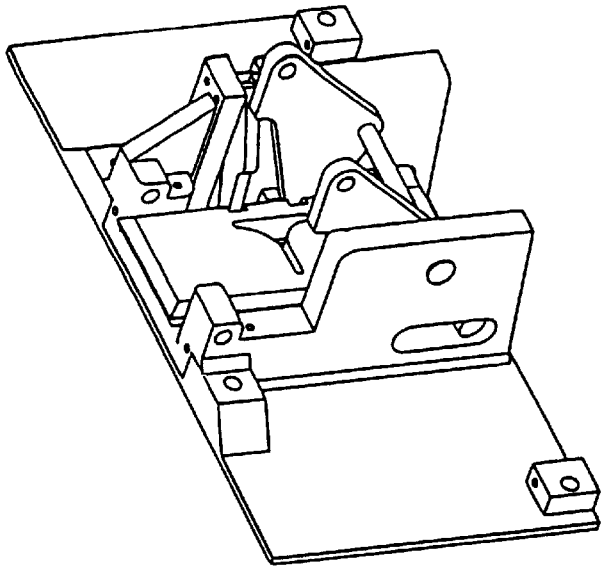
Figure 5A:
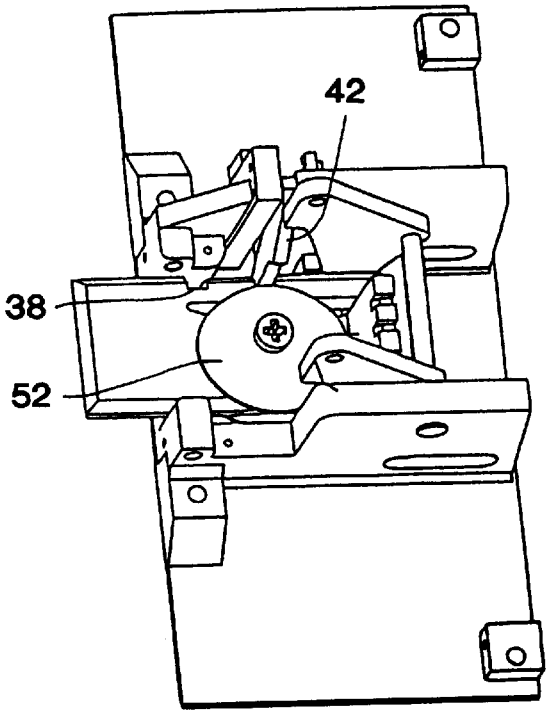
FIGS. 5A through 5E are schematic perspective views of the exit device shown in FIG. 2, illustration the operation of the dead locking link, the deadbolt and the timing cam.
Figure 5B:
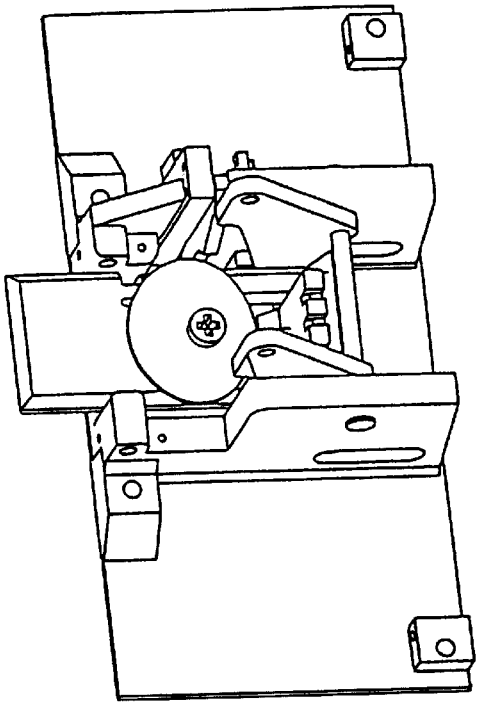
Figure 5C:
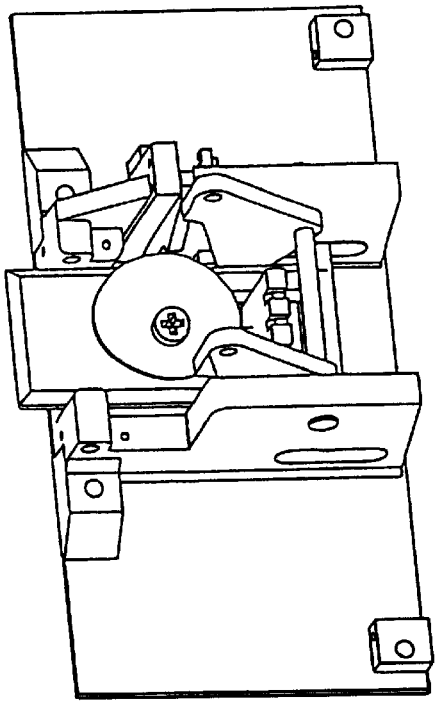
Figure 5D:
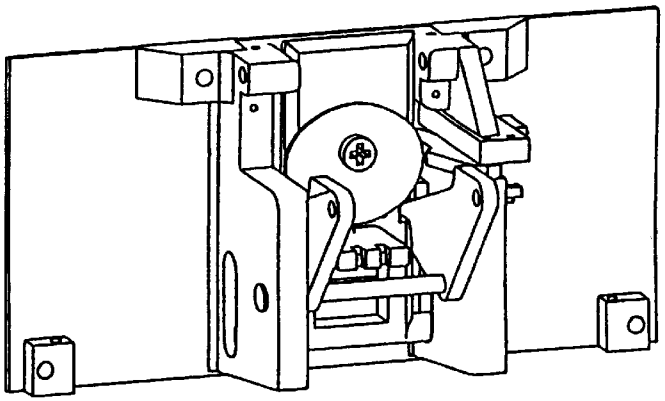
Figure 5E:
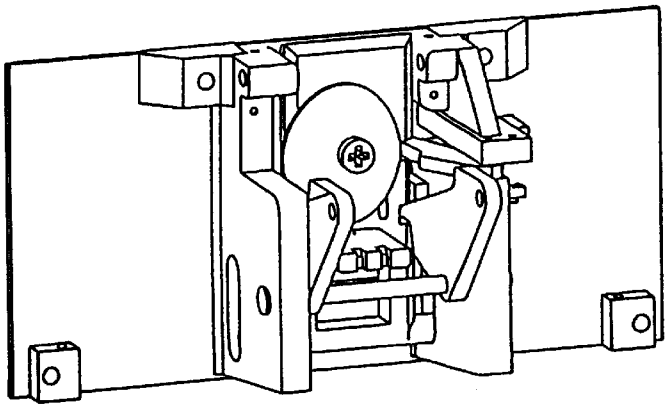

Preferably, this exit device 10 has dead locking in both the extended and retracted positions. A dead locking link 42 is pivotably attached to housing 12. As installed on the door, the dead locking link 42 pivots about a horizontal axis. The dead locking link 42 is biased into engagement with one of two dead locking link notches 38 in an edge of deadbolt 30. One notch 38 corresponds to the deadbolt 30 extended position and the other notch 38 corresponds to the retracted position. The dead locking link 42 is biased into engagement with notches 38 by gravity. However, a spring is preferably used to bias the dead locking link 42. On one of the bell cranks 22, a tooth like cutout 39 is provided. As the bell cranks 22 are rotated by depression of pushbar 20, the tooth like cutout or shoulder 39 contacts an edge of dead locking link 42 and pivots the dead locking link 42 out of engagement with notch 38 (see FIGS. 4A and 4B). Upon further rotation, bell crank back edge 35 contacts deadbolt shoulders 32. Since the dead locking link 42 is no longer engaging notch 38, this further rotation of bell cranks 22 results in the retraction of deadbolt 30 (see FIGS. 4C and 4D). When the pushbar 20 is released, the bell cranks 22 return to their normal position and the dead locking link 42 is biased into engagement with the other notch 38 (see FIG. 4E).

To return the deadbolt 30 to the extended position, and to provide for keyed operation, an inside key cylinder 50 is provided. Although the FIGURES only show a key cylinder for the inside of the exit device 10, a second key cylinder can also be provided to allow operation from the outside of the door. Key cylinder 50 is operably connected to inside timing cam 52, which controls the sequenced movement of the dead locking link 42 and the deadbolt 30. (A second outside timing cam 52 is provided for operation by the optional outside key cylinder.) Timing cam 52 further controls the operation of an alarm arming circuit, described in co-pending application, Ser. No. 09/565,348, filed May 5, 2000 and provisional patent application, serial No. 60/133,027, filed May 7, 1999, the disclosures of which are hereby incorporated by reference. The timing cam 52 has a dead locking cam portion 62 thereon, i.e., its outer diameter, which, as the timing cam 52 is rotated, contacts the dead locking link 42 and moves the dead locking link out of engagement with notches 38. Timing cam 52 further has a deadbolt boss 60 extending from it. Boss 60 engages a chamfered T slot 40 to move the deadbolt 30 between the extended position and the retracted position.

Figure 6:
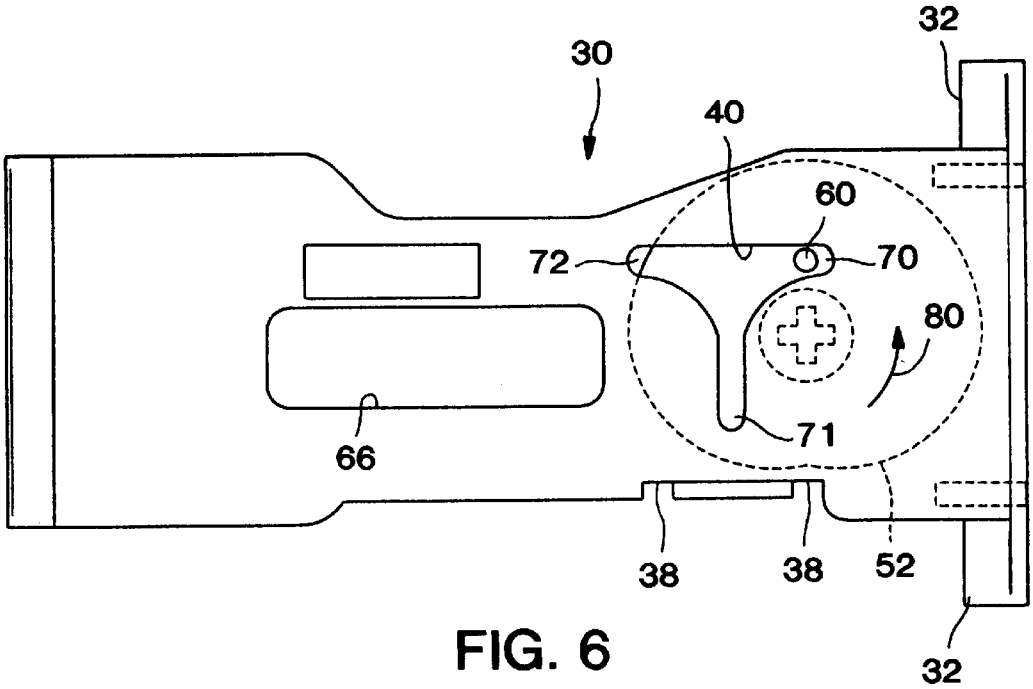
FIG. 6 is a top view of the deadbolt and the outside timing cam.
Figure 7:
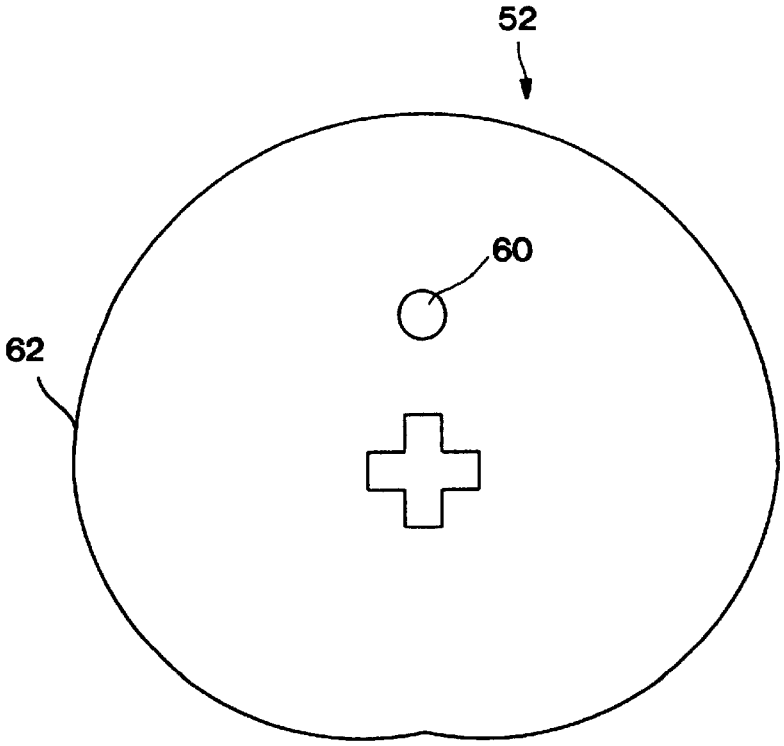
FIG. 7 is a top view of the timing cam.

FIGS. 5A through 5E illustrate the operation of the timing cam 52. As the cam 52 is initially rotated, (in the direction of arrow 80) dead locking link cam portion 62 contacts the dead locking link 42 and moves it out of engagement with notch 38 (see FIG. 5B). During this initial movement, boss 60 moves from position 70 (see FIG. 6) to position 71. Because of the chamfered T shape of slot 40, no movement of the deadbolt 30 occurs. Upon further rotation, boss 60, through engagement of slot 40 at point 71, moves deadbolt 30 to the retracted position (see FIGS. 5C and 5D). Continued movement of timing cam 52 returns timing cam 52 to its original position, allowing the dead locking link 42 to engage the other notch 38 (see FIG. 5E). During this last movement of timing cam 52, boss 60 moves from point 71 to point 72.

The purpose for deadlocking the exit alarm lock deadbolt 30 is to make the mechanism more tamper resistant from the inside as well as the outside. When deadlocked, the deadbolt 30 can not be forced into movement, except as a result of the key cylinder 50 or the pushbar 20. This design deadlocks the deadbolt 30 in both the extended (latched) and retracted positions. The extended position deadlocking prevents vandals from shaking or prying the deadbolt 30 back which would compromise the security of the opening. Retracted position deadlocking prevents a vandal surprised at the alarm horn from pulling the deadbolt 30 out to the extended position, which would compromise the alarm. The dead locking link 42 ensures that once the deadbolt 30 has reached either an extended or retracted position, it remains in that position unless the pushbar 30 is depressed or the device state is changed with the key cylinder 50.

Dissimilar to prior art in exit alarm lock designs, the dead locking link in exit device 10 operates on a swing/release principle which pivots about a horizontal axis parallel to the face of the door. This pivot design allows for low release forces, good impact resistance, minimal wear, and a more predictable release pattern than is possible with other conventional dead locking methods. The dead locking link 42 operates on three separate inputs: pushbar 20 depression, inside key cylinder 50 rotation, and exterior key cylinder rotation.

The inside and outside key cylinders actuate the dead locking link 42 similarly. During cylinder rotation, the outer diameter of timing cam 52 operably connected to the key cylinder contacts the dead locking link 42 causing it to lift (rotate) from the notch 38 in the deadbolt 30. Once the dead locking link 42 clears this notch 38, the deadbolt 30 is free to slide to a retracted or extended position.

The interface utilized to release the deadlocking during depression of the pushbar 20 is similar to that of the timing cams 52. The pushbar 20 is pivotally connected to bell cranks 22, 24 which control and stabilize the motion of the pushbar 20. As the pushbar 20 is depressed, and the bell cranks 22, 24 are rotated, a "tooth like" cutout 39 on bell crank 22 contacts a surface of the dead locking link 42, causing it to rotate out of the deadbolt engagement slot 38. Continued bell cranks 22 rotation holds the dead locking link 42 in this rotated state which maintains the deadbolt 30 in a non-dead locked condition. Once the bell crank 22 is allowed to return to its original position, the dead locking link 42 returns to its locked state, preferably via spring loading.

The keying of the exit device 10 enables an authorized user to arm and disarm the device from the inside or outside of the door. The arming cycle serves two purposes: to mechanically extend (latch) the deadbolt 30 and to electrically engage the audible alarm trigger into its active state. The disarming cycle serves to retract the deadbolt and disengage the audible alarm, which leaves the device in an unlatched and passive state. The key rotates 360° to extend or retract the deadbolt 30. The first 90° moves the dead locking link 42 out of the way, the next 180° moves the deadbolt 30, and the remaining 90° returns the mechanism to the deadlocked state (see FIGS. 5A through 5E). By utilizing the full 360° motion, the keying operates smoothly and with low turning input torque. The deadbolt 30 is moved using a chamfered "T" slot 40 cut into the deadbolt 30 and a boss 60 extending off the timing cam 52 to interface with the slot 40. The deadbolt 30 is moved when the boss 60 contacts the lower half of the chamfered "T" slot 40 while the timing cam 52 is being turned. The upper half of the "T" slot 40 provides clearance when the pushbar 30 or the opposite timing cam 52 is actuated. By utilizing the full 360° rotation of the timing cam 52, the key torque forces are minimized and the deadbolt 30 extension can be maximized.

The primary function of an exit alarm lock is to sound notification upon unauthorized egress, to prevent external vandalism from compromising the opening, and to maintain a safe and accessible exit for all building inhabitants to depart through the opening in an emergency or panic situation.

The most significant advantage to this design is in the operation of its deadlocking/release mechanism as it relates to safe egress through the opening. Since the primary drive link (bell crank 22) is used to rotate the dead locking link 42 out of the way before the bell crank 22 contacts the deadbolt 30, there is no intermediate link used to create this mechanism timing. This timing is important, because the deadbolt 30 would not be able to move until the dead locking link 42 has adequately cleared the engagement slot 38 in the deadbolt 30. By eliminating an intermediate link, the possibility of malfunction or mechanism binding due to manufacturing variation or tolerance stack is inherently reduced. The swing design of the dead locking link 42 allows for extremely low actuation forces due to the ease with which the rotary bell crank motion can be converted to rotary motion of the dead locking link 42. This low deadlocking release force results in a low and predictable force actuation pattern for the device.

In addition, the resistance to internal or external tampering is enhanced by the deadlock/deadbolt arrangement. The dead locking link axis (horizontal line parallel to the face of the door) is in approximate alignment with the dead locking link 42 center of mass and the deadlock/deadbolt lock interface. This allows the device to be much more tolerant to impact loading and shock, especially since most forms of external loading will act parallel to this described alignment. As an impact "force" passes through the centercase housing 12 and into the dead locking link 42, the resultant acceleration of the dead locking link 42 will act to keep the dead locking link 42 is its approximate location (engaged with the deadbolt 30). Since the deadbolt 30 deadlocks in both the extended and retracted positions, it remains locked under various methods of attempted vandalism, better securing the device and opening from internal and external abuse.

Finally, the bell crank/deadbolt interface allows consistent deadbolt 30 retraction even when the door is under a load to push the door open. This is achieved through the mechanical advantage designed into the bell crank 22, 24, pushbar 20 and deadbolt 30 geometries. After rotating the dead locking link 42 clear of the engagements slots 38, the bell crank 22 then contacts the deadbolt 30 directly, eliminating the need for an intermediate link; which would inherently add tolerance and manufacturing variation to the stability of the design. Due to the mechanical advantage of this design, requirements for loaded release forces are better met than in the prior art.

Although Applicants' preferred embodiment of the exit alarm lock incorporates all of the described features, these features have utility when used separately or in combination and the use of all of the described features together is not necessary to solve the problem of a more vandal resistant and more reliable exit alarm lock.

Having described the invention, what is claimed is:

1. An exit device comprising:

a push pad moveable between an extended position and a depressed position;

a pivotable first bell crank, a first end of the first bell crank being connected to a first end of the push pad;

a pivotable support connected to a second end of the push pad;

a deadbolt moveable between a retracted position and an extended position, a second end of the first bell crank directly engaging the deadbolt, whereby when the push pad is moved to the depressed position, the push pad pivots the first bell crank, the first bell crank second end contacts the deadbolt and moves the deadbolt from the extended position to the retracted position; and a dead locking link for preventing movement of the deadbolt, the dead locking link being moveable between a first position engaging the deadbolt and a second position not engaging the deadbolt whereby, when the push pad is moved to the depressed position, the push pad pivots the first bell crank, the first bell crank contacts the dead locking link and moves the dead locking link out of engagement with the deadbolt.

2. The exit device according to claim 1, wherein the pivotable support is a second bell crank, one end of the second bell crank being connected to the second end of the push pad.

3. The exit device according to claim 1, further comprising a housing, the pivot point of the first bell crank and a pivot point of the pivotable support being connected to the housing, the deadbolt slidably engaging the housing.

4. The exit device according to claim 1, further comprising key means for moving the deadbolt between the retracted position and the extended position.

5. The exit device according to claim 1, further comprising alarm means, the alarm means having an armed condition and an unarmed condition, for, when the alarm means is in the unarmed condition, generating an audible alarm when the deadbolt is moved from the extended position to the retracted position.

6. The exit device according to claim 1, further comprising timing means for moving the dead locking link out of engagement with the deadbolt prior to the first bell crank second end contacting the deadbolt.

7. The exit device according to claim 1, wherein the timing means comprises a shoulder on the first bell crank and proximate the first end of the first bell crank, whereby, when the first bell crank pivots, the first bell crank shoulder contacts the dead locking link, thereby moving the dead locking link out of engagement with the deadbolt, prior to the first bell crank second end contacting the deadbolt.

8. The exit device according to claim 7, wherein the deadbolt has two dead locking link engagement apertures in one edge thereof, the dead locking link engaging one of the two engagement apertures when the deadbolt is in one of the extended position or the retracted position.

9. The exit device according to claim 1, wherein the dead locking link engages the deadbolt in both the extended position and the retracted position.

10. The exit device according to claim 1, further comprising key means for moving the deadbolt between the retracted position and the extended position.

11. The exit device according to claim 10, further comprising timing means, operated by the key means, for moving the dead locking link out of engagement with the deadbolt prior to the key means moving the deadbolt between an extended position and a retracted position.

12. The exit device according to claim 10, wherein the key means includes a rotatable key cylinder and the timing means comprises a rotatable timing cam operably connected to the key cylinder, the timing cam including a dead locking link cam portion and a deadbolt cam portion, whereby, when the key cylinder is rotated, thereby rotating the timing cam, the dead locking link cam portion contacts the dead locking link and moves the dead locking link out of engagement with the deadbolt prior to the deadbolt cam portion contacting the deadbolt and moving the deadbolt between the extended position and the retracted position.

13. The exit device according to claim 12, wherein the deadbolt has a chamfered T slot therein and the deadbolt cam portion includes a boss extending therefrom and engaging the T slot.

14. The exit device according to claim 1, wherein the deadbolt has a pair of shoulders thereon, the second end of the first bell crank contacting a shoulder when the push pad is moved to the depressed position.

15. An exit device comprising:

a push pad moveable between an extended position and a depressed position;

a pivotable first bell crank, a first end of the first bell crank being connected to a first end of the push pad;

a pivotable support connected to a second end of the push pad;

a deadbolt moveable between a retracted position and an extended position; and a dead locking link for preventing movement of the deadbolt, the dead locking link being moveable between a first position engaging the deadbolt and a second position not engaging the deadbolt whereby, when the push pad is moved to the depressed position, the push pad pivots the first bell crank, the first bell crank contacts the dead locking link and moves the dead locking link out of engagement with the deadbolt.

16. The exit device according to claim 15, further comprising timing means for moving the dead locking link out of engagement with the deadbolt prior to the first bell crank operatively engaging the deadbolt.

17. The exit device according to claim 16, wherein the timing means comprises a shoulder on the first bell crank and proximate the first end of the first bell crank, whereby, when the first bell crank pivots, the first bell crank shoulder contacts the dead locking link, thereby moving the dead locking link out of engagement with the deadbolt, prior to the first bell crank operatively engaging the deadbolt.

18. The exit device according to claim 15, wherein the dead locking link engages the deadbolt in both the extended position and the retracted position.

19. The exit device according to claim 18, wherein the deadbolt has two dead locking link engagement apertures in one edge thereof, the dead locking link engaging one of the two engagement apertures when the deadbolt is in one of the extended position or the retracted position.

* * * * *